United States Patent [19]

Jamaluddin

[11] 4,240,787

[45] Dec. 23, 1980

[54] DRYING OVEN WITH HEAT RECLAMATION AND AIR POLLUTION CONTROL SYSTEM

[76] Inventor: Aziz A. Jamaluddin, 1912 Nursery Rd., Woodlands, Tex. 77380

[21] Appl. No.: 50,085

[22] Filed: Jun. 19, 1979

[51] Int. Cl.[3] ..... F27D 7/04; F27B 19/00

[52] U.S. Cl. ..... 432/21; 34/86; 432/1; 432/72

[58] Field of Search ..... 432/1, 8, 21, 72; 34/86

[56] References Cited

U.S. PATENT DOCUMENTS

| | | | |
|---|---|---|---|
| 2,750,680 | 6/1956 | Houdry et al. | 34/86 X |
| 3,437,321 | 4/1969 | Wilkinson | 34/79 X |
| 3,627,290 | 12/1971 | Grieve | 432/72 |
| 4,017,254 | 4/1977 | Jones | 432/72 |
| 4,092,100 | 5/1978 | Phillips | 432/219 |
| 4,133,636 | 1/1979 | Flynn | 432/72 |
| 4,140,467 | 2/1979 | Ellison et al. | 432/59 |

*Primary Examiner*—John J. Camby
*Attorney, Agent, or Firm*—Neal J. Mosely

[57] ABSTRACT

A system of drying ovens is disclosed with associated means for heat reclamation and air pollution control. The ovens are primarily for drying or baking paint or other coatings on pipes or the like where the emissions are primarily hydrocarbons.

In this system of ovens, hydrocarbon fumes are concentrated at the ends of the oven. Solvent laden fumes are, therefore, collected where the concentration is the highest. The exhaust from the oven is located at the central portion and leads to a combustion/incineration chamber where it is exhausted to atmosphere after incineration and a major part of the heat is recovered and recirculated to the oven. In a sequence of ovens, the exhaust from one oven is circulated to the next at a high linear velocity, but low volume (at 25% LEL) and heated to a high temperature (1400° F.) by in-line incineration of the fumes. The low volume, high velocity, high temperature gasses are mixed with a high volume, low velocity, low temperature exhaust collected from the end of that oven.

This incineration and mixing and recirculation of gasses is repeated in each succeeding oven and no gasses are exhausted to atmosphere until the last oven. In the last oven, in sequence, a burner is provided to incinerate fumes recirculated at one end of the oven and the exhaust goes to atmosphere through an incinerator/heat exchanger where the reclaimed heat is supplied to outside air being fed to support combustion in the incinerator at one end of the last oven.

20 Claims, 10 Drawing Figures

DRYING OVEN WITH HEAT RECLAMATION AND AIR POLLUTION CONTROL SYSTEM

BACKGROUND OF THE INVENTION

1. Field of the Invention

This invention relates to improved systems of drying ovens having associated means for heat reclamation and air pollution control and to methods of operating same. The ovens are primarily for drying or baking of paint or other coatings or pipes or the like where the emissions are primarily hydrocarbons.

2. Brief Description of the Prior Art

In pipe-coating operation, organic coatings are applied internally. In such operations, where progressive paint baking is involved, there are multiple ovens located in sequence. These ovens operate, in most cases, at different temperatures. The physical size of the ovens and the operating parameters differ according to the size of the pipe being coated. Conventional practice is to use fume incineration on the exhaust from each oven to oxidize the hydrocarbon emissions. A number of prior art patents disclose various arrangements for oxidative control of emissions from drying ovens.

Flynn U.S. Pat. No. 4,133,636 discloses an oven for treating web stock, especially a tentor for treating textile fabric, to remove volatile combustible substances therefrom. The oven employs a recycle circuit in which the temperature of the oven discharge gaseous stream is first raised by combustion of the volatilized substances therein, and then lowered by entry of cooler, supplemental air, after which part of the gaseous oven discharge gaseous stream is first raised by combustion of the volatilized substances therein, and then lowered by entry of cooler, supplemental air, after which part of the gaseous stream is returned to the oven and part used for pre-heating of stock or post-heating in other oven sections.

Wilkinson U.S. Pat. No. 3,437,321 discloses a paint-drying system in which the vapors of the volatile solvents are burned to eliminate pollution of the atmosphere and heating is reclaimed from such combustion.

Grieve U.S. Pat. No. 3,627,290 discloses an air pollution control system in which a stream of hot gas and air, exiting from a drying, baking, or curing oven, and containing pollutants is diverted through an incinerator, where the pollutants are burned to water and carbon dioxide. There is an intricate damper control system for regulating flow of gasses in accordance with oven temperature.

Jones U.S. Pat. No. 4,017,254 discloses a recirculating furnace-dryer combination including a combustion chamber, a housing surrounding the combustion chamber for maintaining a super-atmospheric pressure within the combustion chamber, dryer in which a super-atmospheric pressure may be maintained and a feed conduit through which the heated gasses may be supplied from the combustion chamber to the dryer. Return conduits recirculate exhaust gasses from the dryer for repressurization into the housing from which they are recirculated into the combustion chamber. The system is provided with temperature sensing devices and pressure sensing devices for control of flow of combustion and dryer gasses.

Phillips U.S. Pat. No. 4,092,100 discloses a drying oven for painted surfaces wherein the work is heated and dried by heated high pressure air blown against the work as it passes through the oven. The solvents stripped from the work are incinerated and the heat recovered from makeup heated air to the furnace.

These prior art patents suffer from the disadvantage that their systems are quite complicated, large in size, and quite expensive to build. In addition, in some cases, very intricate and expensive controls are required which add to the expense of the system.

SUMMARY OF THE INVENTION

One of the objects of this invention is to provide a new and improved air pollution and heat reclamation system for coating or curing ovens.

Another object of this invention is to provide a new and improved air pollution control system for a plurality of coating or curing ovens operated in sequence having no emission into the atmosphere of volatile pollutants.

Another object of this invention is to provide an improved system for coating or curing ovens which is highly energy efficient in reclamation of heat of combustion of pollutant materials.

Still another object of this invention is to provide a new and improved system for air pollution control and heat reclamation from coating or curing ovens utilizing less expensive equipment and having lower operating costs. Still another object of this invention is to provide a new and improved air pollution control and heat reclamation system for coating or curing ovens utilizing equipment which is more compact.

Another object of this invention is to provide a new and improved method of operation of coating or curing ovens and associated pollution control and heat reclamation equipment wherein low volume, high velocity, high temperature air containing combustible pollutants burned in line is mixed with and dispersed into a large volume of low velocity low temperature air recirculating within an individual drying or curing oven.

Another object of this invention is to provide an improved method of operation of air pollution control and heat reclamation equipment associated with drying or curing ovens which results in lower operating costs and higher energy efficiency coupled with substantial elimination of emission of pollutants into the atmosphere.

Other objects of this invention will become apparent from time to time throughout the specification and claims as hereinafter related.

This invention provides a system of drying ovens with associated means for heat reclamation and air pollution control which attains the aforementioned objectives. The ovens are primarily for drying or curing or baking paint or other coating pipes or the like where emissions are primarily hydrocarbons.

In pipe coating operations, organic coatings are applied internally. In such operations, where progressive paint baking is involved, there are multiple ovens located in sequence. These ovens operate, in most cases, at different temperatures. The physical size of the ovens and operating parameters differ according to the size of the pipe being coated. Conventional practice has been to use fume incineration on the exhaust from each oven to oxidize the hydrocarbon emissions.

In this system of ovens, hydrocarbon fumes are concentrated at the ends of the oven. Solvent laden fumes are therefore collected where the concentration is the highest. The exhaust from the oven located at the central position and leads to a combustion-incineration chamber where it is exhausted to atmosphere after incineration and a major part of heat is recovered and recirculated into the oven. In a sequence of ovens, the exhaust from one oven is circulated to the next at a high linear velocity but low volume (at 25% LEL) and heated to a high temperature (1400° F.) by in-line incineration of the fumes. The low volume high velocity high temperature gasses are mixed with a high volume, low velocity, low temperature exhaust connected from the end of that oven. This incineration and mixing and recirculation of gasses is repeated in each successive oven and no gasses are exhausted to atmosphere until the last oven. In the last oven in sequence, a burner is provided to incinerate fumes recirculated at one end of the oven and the exhaust goes to the atmosphere through an incinerator-heat exchanger where the reclaimed heat is supplied to outside air being fed to support combustion in the incinerator at said one end of the last oven.

BRIEF DESCRIPTION OF THE DRAWINGS

FIG. 6 is a detail view, partially in section, of the incinerator, associated combustion chamber C and associated heat exchanger used in certain of the ovens.

DESCRIPTION OF THE PREFERRED EMBODIMENTS

In pipe-coating operations, organic coatings are applied internally. The pipe is usually projected first to a thermal burn off operation in a high temperature oven used to burn off any oil coatings or scales or paraffin deposits, etc., from the pipe surfaces before application of paint or other coatings. The pipe, thus treated, is then passed to a progressive sandblasting operation and paint or coating baking or curing operation using multiple ovens located in sequence. These ovens operate, in most cases, at different temperatures. The physical size of the ovens and operating parameters differ according to the size of the pipe being coated. The thermal burn off oven and the sequential ovens used in baking or curing the paint or other coating produce a substantial amount of hydrocarbon emissions which may not be discharged to atmosphere under federal and state air pollution controls.

THERMAL BURN OFF OVEN

Figure 1:
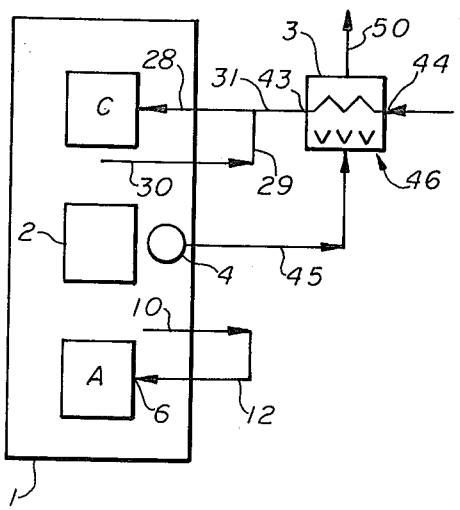
FIG. 1 is a schematic view of a thermal burn-off oven and associated air pollution control and heat reclamation equipment.

In FIG. 1, there is shown schematically a thermal burn off oven 1 which is used to burn off oil coatings or scales, etc., from pipe surfaces before application of paint or other coating. The oven 1 is provided with a purge fan 2 for quick purging of the oven before startup. The normal exhaust from the oven is very small and it would take a relatively long time to ventilate five to to six oven volumes. Therefore, purge fan 2 is provided for a quick purge prior to startup. Oven 1 is provided with a special combustion chamber C which is associated with a heat exchanger 3 and is shown in more detail in FIG. 6. At the other end of oven 1, there is provided another combustion chamber A which is shown in more detail in FIG. 4 of the drawings. An exhaust fan 4 is located at the center of oven 1 and discharges to one side of heat exchanger 3.

Figure 4:
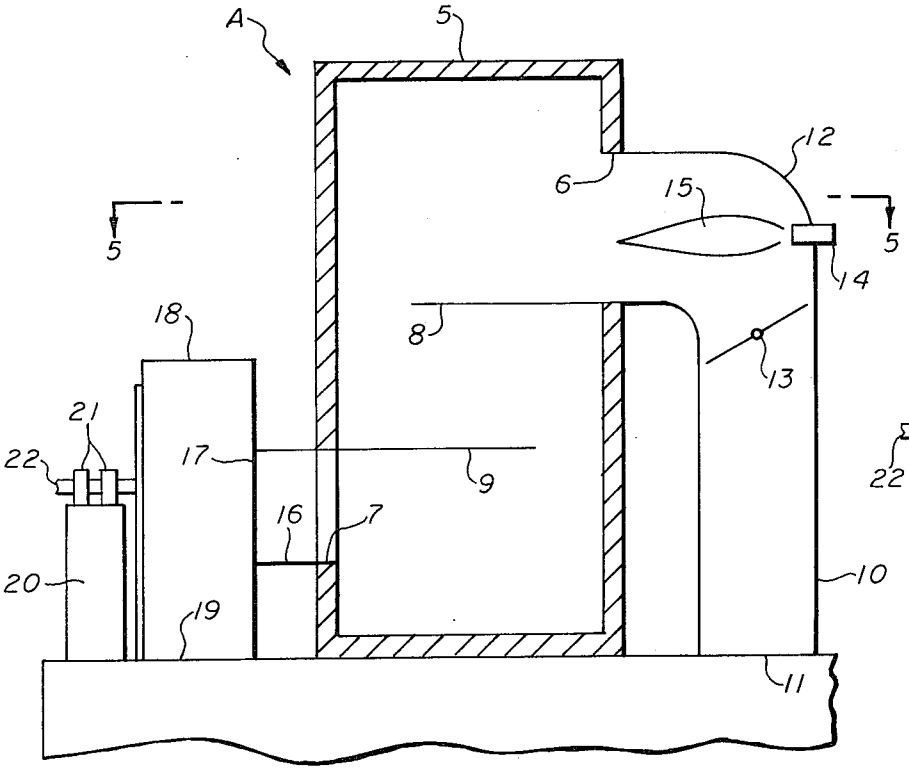
FIG. 4 is a detail view, partially in section, of an incinerator and associated combustion chamber A used in certain of the dryer.
Figure 5:
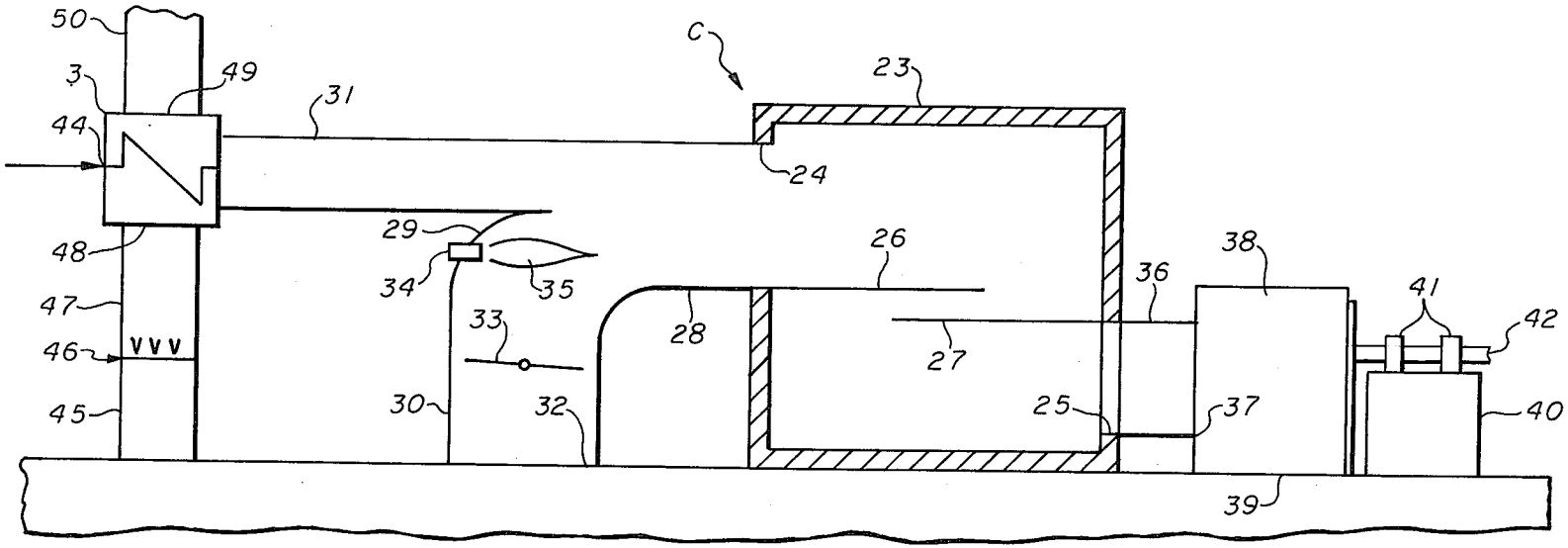

Combustion chamber unit A, as shown in FIG. 4, comprises an insulated chamber 5 having inlet 6 and outlet 7 and internal baffles 8 and 9 providing a tortuous path therethrough. Insulated chamber 5 preferably has walls about six inches thick of eight-pound density mineral wool insulation. Combustion chamber A is connected by insulated conduit 10 which has an open bottom end 11 opening into the oven and has an upper elbow 12 opening into opening 6 in insulated chamber 5.

Conduit 10 is provided with a volume control damper 13. Burner nozzle 14 is positioned at elbow 12 and projects a flame 15 to heat the circulating air and burn part of the combustibles in the oven emissions being circulated through combustion chamber A. Outlet 17 from combustion chamber 5 is connected by insulated conduit 16 to the inlet 17 of a heavily insulated recirculation fan 18. Fan 18 has an outlet 19 discharging back into the oven with which the combustion chamber A is associated. Supporting block 20 supports the bearings 21 for the shaft 22 of fan 18 (fan motor is not shown). The arrangement shown and described is schematic. In actual construction burner A, fan 18 and conduit 10 would be enclosed as a single unit with the various conduits located internally.

Combustion unit C, located at the other end of oven 1, is shown in more detail in FIG. 6. Combustion unit C includes combustion chamber 23 which has walls that are highly insulated, preferably about six inches thick mineral wool. Combustion chamber 23 has inlet opening 24, outlet opening 25 and mixing baffles 26 and 27. Inlet opening 25 is connected to the outlet end 28 of elbow 29 which is connected to conduit 30 on one side and conduit 31 on the other side. Conduit 30 has an open end 32 opening into the oven. A volume control damper 33 is provided to control the volume end velocity of gasses circulating. Burner nozzle 34 is positioned in elbow 29 and projects a flame 35 for heating the air and partially burning combustible gasses in the oven. Conduits 28, 30 and 31 and elbow 29 are heavily insulated.

The outlet 25 from combustion unit 23 is connected by insulated conduit 36 to the inlet 37 of heavily insulated fan 38. The outlet 39 of fan 38 discharges into plenum inside the oven. Supporting block 40 supports bearings 41 which support shaft 42 of fan 38 (the fan motor is not shown). The arrangement shown and described is largely schematic. In actual construction the burner, fan and conduits would be enclosed in a single unit with the various conduits located internally.

Insulated conduit 31 is connected to the outlet side 43 of heat exchanger 3. The inlet side 44 of heat exchanger 3 receives air at ambient temperature which is preheated in heat exchanger 3 to reclaim the heat from the exhaust gasses from the oven. Heat exchanger 3 is shown schematically and may be a rotary heat exchanger or a shell and tube heat exchanger or other suitable design.

Figure 8:
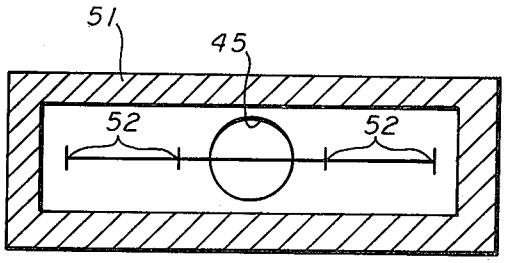
FIG. 8 is a sectional view of one of the induct heaters taken on the section line 8—8 of FIG. 7.
Figure 7:
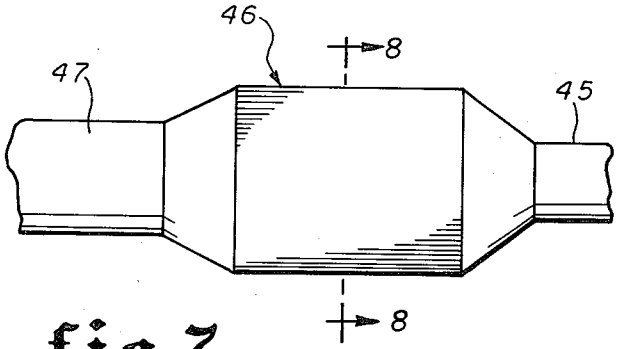
FIG. 7 is a plan view of an induct heater as used in certain of the ovens.

Exhaust fan 4 from oven 1 is connected by conduit 45 to one side of in-duct burner 46, which is shown in more detail in FIGS. 7 and 8. The other side of in-duct burner 46 is connected by conduit 47 to one side 48 of heat exchanger 3. The other side 49 of heat exchanger 3 is connected to conduit 50 venting to atmosphere. In-duct burner 46 comprises a heavily insulated chamber 51 having walls of refractory material about six inches thick. Chamber 51 is considerably enlarged relative to the duct 45 to which it is connected and provides an enlarged chamber with a gas dwell time of 0.5 seconds at 1400° F., for combustion of hydrocarbons and other volatiles in the gasses being circulated. Chamber 51 includes a plurality of gas jet openings 52 which provide flames for igniting and totally burning the hydrocarbons or other combustible materials in the gasses circulating therethrough.

OPERATION OF THERMAL BURN OFF OVEN

Thermal burn off oven 1 is purged by operation of fan 2 prior to operation of the oven. The oven is loaded with pipe from which oil or scale is to be removed by heating to an elevated temperature. Thermal burn off oven 1 is a low velocity oven using a plenum chamber and is of conventional internal design. Thermal burn off oven 1 is operated at about 700° F. for burning off oil and scale from pipe (or other product) treated in the oven. The circulation of air is such as to maintain the hydrocarbon emissions at about 25% LEL (lower explosive limit).

When oven 1 is being operated, air containing hydrocarbon emissions from the burn-off is collected at opposite ends of the oven and circulated back to the central portion where the emissions are removed by exhaust fan 4. At one end of oven 1 combustion unit A circulates air and hydrocarbon emissions through conduit 10 past damper 13 into the path of flame 15 which heats the circulating air and ignites the hydrocarbons and initiates a partial combustion thereof. The gaseous mixture passes into combustion chamber 5 and circulates along a tortuous path directed by baffles 8 and 9. After leaving combustion chamber 5 the gaseous mixture is drawn by fan 18 and discharged back into the plenum chamber for the oven. Circulation of air by recirculating fan 18 is at a relatively high flow rate, viz. 12,000 SCFM.

At the other end of burn-off oven 1, combustion unit C has a mixture of air and hydrocarbon emissions circulated therethrough by fan 38 which has a circulating capacity of about 12,000 SCFM. This mixture of air and hydrocarbon emissions is drawn through conduit 30 past control damper 33 and into the path of flame 35 which heats the air and burns part of the hydrocarbons. The burning mixture then passes into combustion chamber 23 and follows a tortuous path past baffles 26 and 27 and is finally returned to the plenum chamber for the oven through recirculating fan 38. The discharge from thermal burn-off oven 1 is by means of exhaust fan 4 which circulates a mixture of air and hydrocarbon emissions through insulated conduit 45 into in-duct burner 46. This burner operates without any supplemental air and functions to burn substantially all of the hydrocarbons contained therein. The effluent from in-duct burner 46 passes through conduit 47 and crosses heat exchanger 3. The air circulating along this path has a temperature of about 700° F. at a flow rate of 832 SCFM on leaving oven 1 through conduit 45. The combustion of substantially all of the hydrocarbon components in in-duct burner 46 raises the temperature to 1400° F. This high temperature gas passing through heat exchanger 3 causes fresh air entering inlet 44 at 70° F. (or ambient temperature) to be heated to 850° F. The amount of air introduced through inlet 44 to heat exchanger 3 is the same amount, viz. 832 SCFM, which is being removed through the exhaust line. The heated air, at 850° F. is introduced through conduit 31 into elbow 29 where it mixes with the burning mixture of air and hydrocarbons circulating into combustion chamber 23. The heat exchanger 3 has a 60% efficiency and the exhaust through conduit 50 to atmosphere is at 550° F. and a flow rate of 832 SCFM. The effluent from line 50 is essentially free of hydrocarbon and other combustible contaminant. The hydrocarbon and other combustible contaminant level is well below the allowable limits established by EPA.

BAKING AND CURING OVENS

Figure 2:
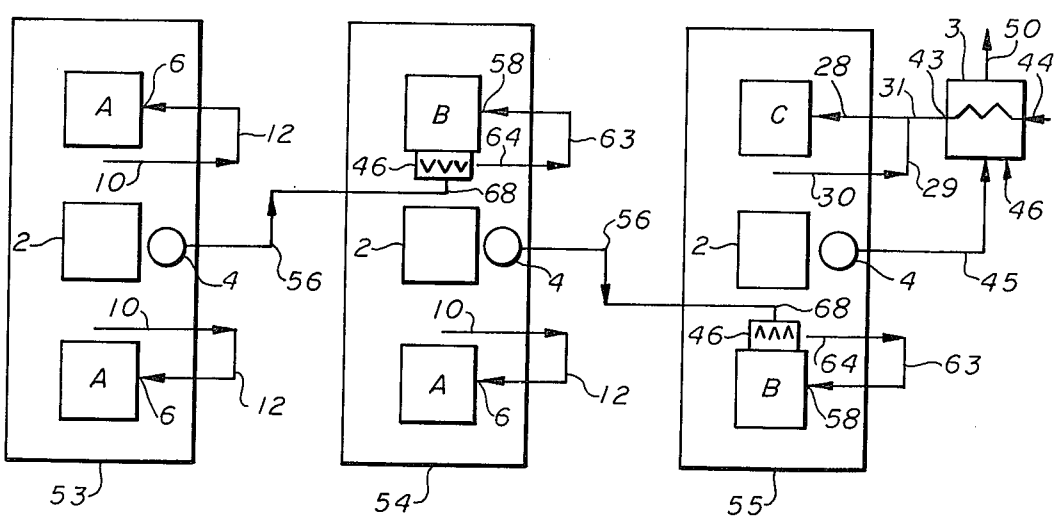
FIG. 2 is a schematic view of a system of three sequential drying ovens for drying and curing coatings on pipe, and the air pollution control and heat reclamation equipment associated therewith.

In FIG. 2, there is shown a series of baking and curing ovens for painting or coating the inside of pipe. These ovens are constructed somewhat similarly to the one shown in FIG. 1 and have certain features that are the same. Oven 53 is the prime bake oven and is designed to maintain the metal pipe at a temperature of 200°–250° F., with an operating air temperature of 300° F. Oven 54 is a low temperature intermediate bake oven designed to heat pipe to a temperature of 250°–300° F., using an operating air temperature of 350° F. Oven 55 is a high-temperature final bake oven which is designed to maintain the pipe at a temperature of 400°–450° F. using an operating air temperature of 550° F.

Figure 5:
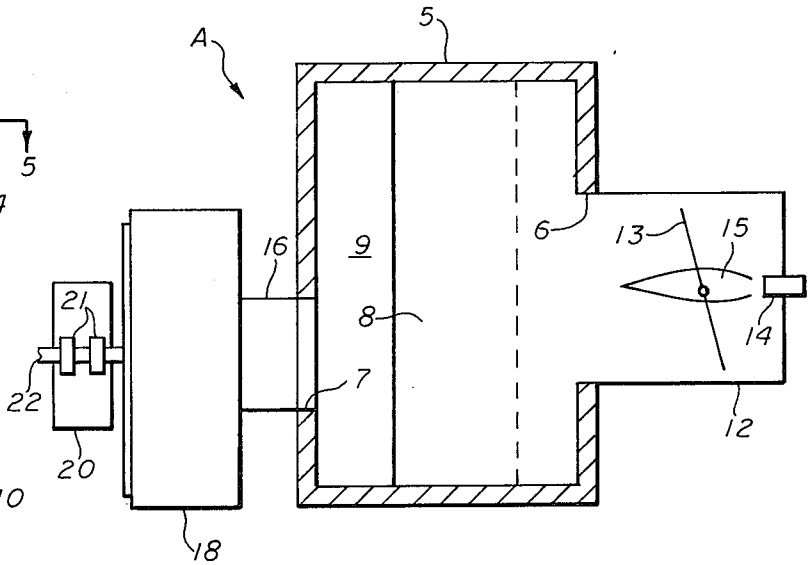
FIG. 5 is a sectional view taken on the line 5—5 of FIG. 4.

The prime bake oven 53 is provided with a purge fan 2 and an exhaust fan 4 which functions identically to the purse and exhaust fans in burn off oven 1. Prime bake oven 53 has a pair of combustion units A located at opposite ends of the oven. The combustion units A are as shown in FIGS. 4 and 5 and are constructed and operated in the same manner as combustion units A in the thermal burn off oven 1 and function to maintain the desired air temperature in the oven.

Exhaust fan 4 is connected by insulated conduit 56 which leads to one side of combustion unit B in the low temperature intermediate bake oven 54. Combustion unit B is shown in detail in FIG. 3. Oven 54 has a purge fan 2 and an exhaust fan 4 which is identical in construction and operation to the corresponding unit in ovens 1 and 53. At the opposite end of oven 54 from combustion unit B there is provided combustion unit A which is identical to and performs the same function as combustion unit A in oven 53 and in oven 1.

Figure 3:
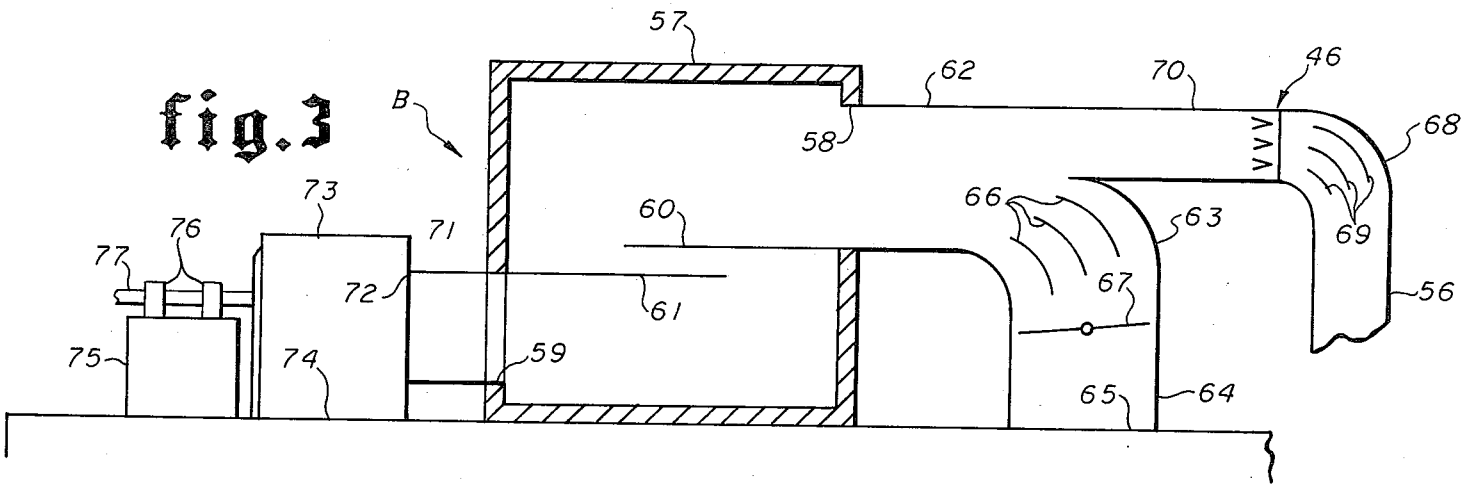
FIG. 3 is a detail view, partially in section, of incinerator system and combustion chamber B used in certain of the drying ovens.

Combustion unit B is shown in detail in FIG. 3 and comprises combustion chamber 57 which is a thick wall insulated chamber, preferably about six inch mineral wool. Combustion chamber 57 has inlet 58 and outlet 59 and a pair of baffles 60 and 61 which provide a tortuous path for the flow of combustion products.

The inlet 58 to combustion chamber 57 is connected to insulated conduit 62 which is connected to elbow 63 which is in turn connected to conduit 64 having an opening 65 connecting to the oven. Insulated elbow 63 is provided with a plurality of internal flow directing vanes 66 and a flow regulating damper 67. Insulating conduit 56 leading from exhaust fan 4 on oven 53 is connected to elbow 68 which connects to one side of in-duct burner 46. In-duct burner 46 is constructed as shown in FIGS. 7 and 8 and operates as described for the in-duct burner 46 shown in FIG. 6. Insulated elbow 68 is provided with a plurality of flow directing vanes 69 similar to the vanes 66 in elbow 63. The other side of in-duct burner 46 is connected to insulated conduit 70 which joins conduit 62 adjacent to elbow 63.

The outlet 59 from combustion chamber 57 is connected by insulated conduit 71 to the inlet 72 of a high temperature insulated fan 73. Fan 73 has outlet 74 opening into the plenum inside the oven. Supporting block 75 supports bearings 76 for the shaft 77 of fan 73 (fan motor not shown. )

Exhaust fan 4 of oven 54 is connected by insulated conduit 56 to elbow 68 connecting the in-duct burner 46 on combustion unit B on oven 55. Combustion unit B on final bake oven 55 is identifical in construction and in operation to combustion unit B as shown in FIG. 3 and as just described in connection with intermediate bake oven 54.

Final bake oven 55 is provided with a purge fan 2 and an exhaust fan 4 as in the other ovens. At the end of oven 55 opposite combustion unit B there is provided combustion unit C and associated heat exchange equipment which is identical to that shown in a thermal burn off oven in FIG. 1 and illustrated in detail in FIG. 6. The operation of this equipment is identical to that described above.

OPERATION OF BAKING AND CURING OVENS

Prime bake oven 53 is a side loading oven which is operated at 300° F. air temperature to maintain the painted or coated pipe at a temperature of 200°–250° F. therein. As previously noted, the oven would be thoroughly purged by purge fan 2 at the beginning of operation. When the oven is at operating temperature combustion units A are withdrawing air and hydrocarbon vapors from opposite ends of the oven and circulating said mixture through the flame 15 to heat the air and ignite and partially burn the hydrocarbons in combustion chamber 5. Circulating fans 18 for combustion units A have a capacity of 12,000 SCFM and will circulate the product from the combustion chambers back to the ovens at a linear velocity of 3,000–3,500 FPM at a pressure of about seven inches of water. This recirculation of air and hydrocarbon emissions from the ends of the oven through the respective combustion units and back into the central portion of the oven is effective to maintain the air at the desired temperature and reduce the hydrocarbon content somewhat. There is no discharge of hydrocarbons to the atmosphere from this oven.

The effluent, containing a substantial amount of hydrocarbons from oven 53 is exhausted by fan 4 through insulated conduit 56 to in-duct burner 46 on combustion unit B at one end of low temperature intermediate bake oven 54. Ovens 53 and 54 are both high velocity ovens while final bake oven 55 is a low velocity oven for soaking. The effluent from oven 53 which is transported by insulated conduit 56 to combustion unit B where the hydrocarbon content is completely incinerated in in-duct burner 46. The exhaust from oven 53 is at the oven temperature of 300° F. and at a flow rate of 832 SCFM through a nine-inch diameter pipe conduit 56. In the in-duct burner 46, the combustion products reach a temperature of 1400° F. The outlet from in-duct burner 46 is conduit 70 which is 12 inches in diameter. This 1400° effluent joins the air and hydrocarbon mixture brought from oven 54 through conduit 64 and elbow 63. The gas from the oven is at a temperature of 350° F. and is circulated by action of fan 73 which has a capacity of 12,000 SCFM. Thus, there is a relatively small volume of high temperature gas, viz. the combustion products at 1400° F., being mixed with a very large volume of relatively low temperature, (350° F.) gas. The combustibles in the gas coming from the oven 54 are ignited and partially burned in combustion chamber 57 of combustion unit B and circulated by means of baffles 60 and 61 along a tortuous path and back to the high velocity distributor leading back from fan 73 to the oven.

At the other end of intermediate bake oven 54, combustion unit A circulates a large volume of air containing hydrocarbon emissions from oven 54 through conduit 10 past flame 15. A large volume of gas is handled by fan 18 which has a capacity of 12,000 SCFM. The air which passes flame 15 is heated to the desired temperature and the hydrocarbon emissions contained therein are partially burned. The combustion products pass through combustion chamber 5 along a tortuous path defined by baffles 8 and 9 and back through fan 18 to the distributor which circulates high velocity air back into oven 54. The discharge from fan 18 is at a pressure of 7 inches of water and a linear velocity of about 3,000–3,500 FPM.

The effluent from intermediate bake oven 54 is exhausted by fan 4 through insulated conduit 56 substantially as described in the movement of the effluent from oven 53 to oven 54. In this case, the effluent from oven 54 is moved at a rate of 1250 SCFM of gas and hydrocarbon emissions at a temperature of 350° F. Conduit 56 has a diameter of 11 inches and leads to the in-duct burner 46 on combustion unit B of oven 55. In the in-duct burner, the mixture is substantially completely burned and the temperature reaches a level of 1400° F. The outlet conduit from in-duct burner 46 is conduit 70 which is 16 inches in diameter. The combustion products from in-duct burner 46 is mixed with air which is being recirculated within burner 55 by exhaust fan 73 which draws an air and hydrocarbon emissions mixture from the oven through conduit 64 and elbow 63. This larger volume of gas, which is circulated by a fan having a capacity of 12,000 CFM, is at a temperature of 500° F. and is mixed with a 1400° F. effluent from the in-duct heater 46. In this mixture, the combustion of hydrocarbon component continues in part through combustion chamber 57 along a tortuous path defined by baffles 60 and 61. The effluent from combustion chamber 57 is recirculated by fan 73 back into oven 55. Oven 55, as previously noted, is a low velocity oven and so the discharge from fan 73 is into the plenum chamber for the oven. Combustion unit C, which is located at the other end of oven 55, functions identically to combustion unit C in the thermal burn off oven 1. A large volume of combustible mixture of air and hydrocarbon emissions is drawn past flame 35 and circulates into combustion chamber 23. The mixture, air and combustion products, is provided with heated makeup air supplied from heat exchanger 3. The combustion products move through a tortuous path defined by baffles 26 and 27 and are recirculated by fan 38 back into the center portion of oven 55.

The discharge from over 55 by exhaust fan 4 is at a flow rate of 1500 SCFM at a temperature of 500° F. In the in-duct burner 46, the temperature of the combustion products reaches 1400° F. and the hydrocarbons are completely burned. These combustion products pass through heat exchanger 3 where inlet makeup air flows at a rate of 1500 SCFM and is raised from ambient temperature (70° F.) to 850° F. and moves on through conduit 31 to mix with the combustibles in combustion unit C. The gasses flowing out through stack conduit 50 from heat exchanger 3 are at a rate of 1500 SCFM at a temperature of 550° F. This effluent is substantially completely free of hydrocarbon contaminants. In fact, the hydrocarbon content is well below the permissable levels set by the EPA.

AN ALTERNATE EMBODIMENT

Figure 9:
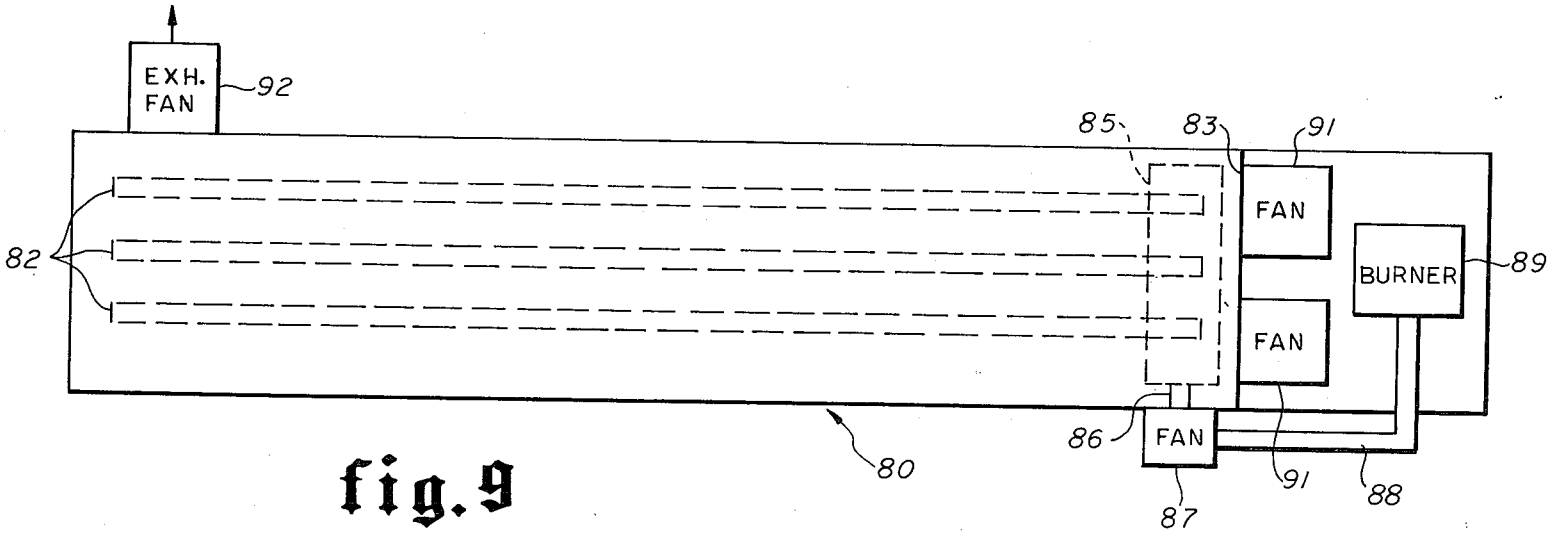
FIG. 9 is a plan view of an alternate air pollution control and heat recovery system.
Figure 10:
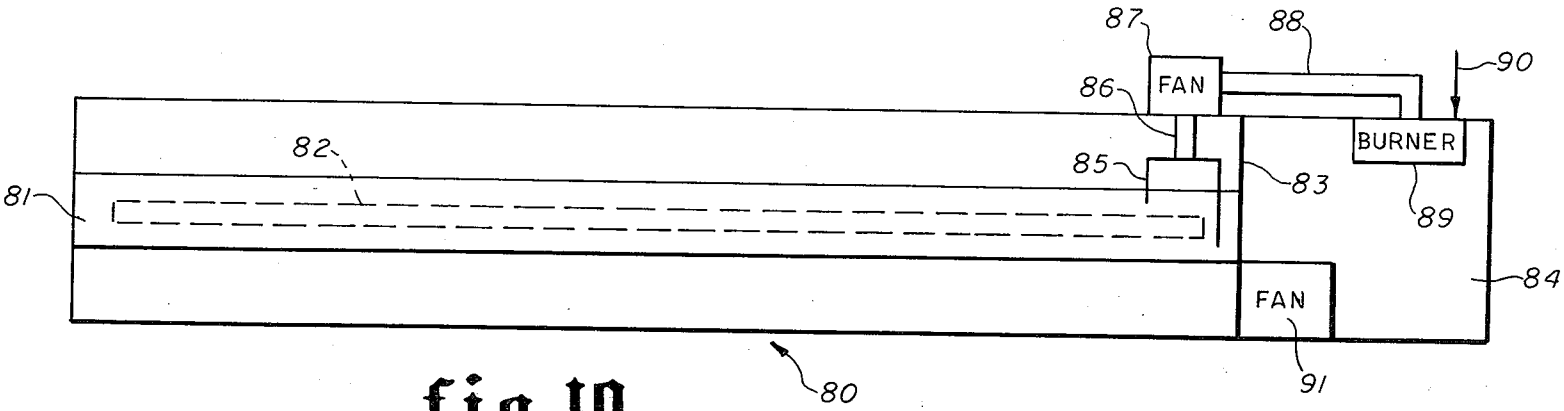
FIG. 10 is a view in side elevation of the embodiment shown in FIG. 9.

In FIGS. 9 and 10, there is shown an alternate embodiment of the method and apparatus of this invention. In this embodiment, the hydrocarbon-laden air from the oven is recirculated through the burner that heats the air for the oven and the hydrocarbon fumes are completely consumed.

FIG. 9 shows a plan view of oven 80, shown in elevation in FIG. 10. Oven 80 has an elongated side door 81 for introduction of pipes 82 therein for drying or curing of coatings.

Oven 80 has an internal wall 83 separating the oven portion from end chamber 84. A hood or manifold 85 is positioned at the end of oven 80 adjacent to wall 83. Manifold 85 is connected by conduit 86 to fan 87 which in turn is connected by conduit 88 to burner 89. A suitable supply of fuel, indicated by arrow 90, is provided for burner, with the combustion air therefor being supplied by fan 87. Chamber 84 has a fan 91 which draws in air from the main oven portion, mixes the air with combustion products from burner 89 for heating, and recirculates the heated air back into the oven. An exhaust fan 92 exhausts air from the oven at a predetermined rate.

OPERATION

In pipe coating operations, the coatings are applied internally and the hydrocarbon fumes are released from the ends of the pipes in the oven. In this embodiment, the air in the oven is continuously recirculated by fan 91 into and out of chamber 84. The circulating air is maintained at the desired temperature by mixing with the combustion products from burner 89.

Fan 87, cooperating with manifold 85, draws air and hydrocarbon fumes only from the ends of pipes 82 extending under manifold 85. The entire internal length of the pipes 82 is continually purged by air from the oven entering the opposite ends of the pipes. All of the fumes from the pipes are therefore drawn out through manifold 85 by fan 87 and introduced into burner 89 and completely burned therein along with additional fuel supplied at 90.

The normal exhaustion of air from the oven is by fan 92 which vents air from the end of the oven opposite manifold 85. This arrangement insures that the air exhausted to atmosphere is substantially free of hydrocarbon fumes, since all of the hydrocarbon fumes are removed through manifold 85 and consumed in burner 89.

While this invention has been described fully and completely with special emphasis upon a single preferred embodiment, it should be understood that within the scope of the appended claims, the invention may be practiced otherwise than as specifically described herein.

I claim:

1. A system of ovens for drying or curing coatings producing combustible emissions, comprising a first oven having a pair of combustion units positioned adjacent to opposite ends thereof, each of said combustion units being positioned to collect air containing combustible gases from respective opposite ends of the oven, oxidize a part of said gases, heat said air, and return the air and combustion products to the oven, a second oven having a pair of combustion units positioned adjacent to opposite ends thereof, each of said last named combustion units being positioned to collect air containing combustible gases from respective opposite ends of the second oven, oxidize part of said gases, heat said air, and return the air and combustion products to the same oven, exhaust means connected from the central portion of said first named oven to one of the combustion units on said second oven to conduct air containing combustible constituents thereto, a combustion unit positioned in said exhaust means adjacent to said last named combustion unit and discharging into the same, exhaust means opening from the central portion of said second oven and discharging to atmosphere, and a combustion unit positioned within said last named exhaust means and operable to oxidize substantially all of the combustible gases in the air flowing therethrough.

2. A system of ovens according to claim 1 in which the other of the combustion units on said second oven has a conduit for conducting outside air thereto, and said last named exhaust means includes a heat exchanger positioned beyond said last named combustion unit and intersecting said conduit to preheat the outside air passing therethrough.

3. A system of ovens according to claim 1 or 2 in which each of said exhaust means comprises an exhaust fan positioned at the oven and a conduit leading therefrom.

4. A system of ovens according to claim 1 or 2 in which said exhaust means from said first oven and the combustion unit herein are of a size to introduce a small volume of high temperature combustion products into a substantially larger volume of low temperature gases.

5. A system of ovens according to claim 1 or 2 in which each of said combustion units on sid first and second ovens includes a combustion chamber having an inlet opening into the oven adjacent one end thereof, a circulating fan associated with each combustion chamber having an inlet connected to the outlet of said combustion chamber and an outlet open to the oven.

6. A system of ovens according to claim 1 or 2 in which each of said exhaust means comprises an exhaust fan positioned at the oven and a conduit leading therefrom, and said conduit leading to said second oven including am in-duct combustion unit comprising an enlarged refractory chamber portion with a plurality of gas fired burners therein, and the outlet therefrom opening into said one combustion unit on second oven.

7. A system of ovens according to claim 1 including a third oven having a pair of combustion units positioned adjacent to opposite ends thereof, each of said combustion units being positioned to collect air containing combustible gases from one end of the oven, oxidize part of said gases, heat said air, and return the combustion products to said oven, exhaust means connected from the central portion of said third oven to one of the combustion units on said first named oven, and a combustion unit positioned in said last named exhaust means adjacent said last named combustion and discharging into the same.

8. A system of ovens according to claim 7 in which the other of the combustion units on said second oven has a conduit for conducting outside air thereto, and said last named exhaust means includes a heat exchanger positioned beyond said last named combustion unit and intersecting said conduit to preheat the outside air passing therethrough.

9. A system of ovens according to claim 7 in which said exhaust means from said first and third ovens and the combustion units therein are of a size to introduce a small volume of high temperature combustion products into a substantially larger volume of low temperature gases.

10. A system of ovens according to claim 8 in which said exhaust means from said first and third ovens and the combustion units therein are of a size to introduce a small volume of high temperature combustion products into a substantially larger volume of low temperature gases.

11. A system of ovens according to claim 7 in which each of said exhaust means comprises an exhaust fan positioned at the oven and a conduit leading therefrom, each of said combustion units on said first, second and third ovens includes a combustion chamber having an inlet opening into the oven adjacent one end thereof, and a circulating fan associated with each combustion chamber having an inlet connected to the outlet of said combustion chamber and an outlet open to the oven.

12. A system of ovens according to claim 8 in which each of said exhaust means comprises an exhaust fan positioned at the oven and a conduit leading therefrom, each of said combustion units on said first, second, and third ovens includes a combustion chamber having an inlet opening into the oven adjacent one end thereof, and a circulating fan associated with each combustion chamber having an inlet connected to the outlet of said combustion chamber and an outlet opening to the oven.

13. A side loading batch oven for treating materials producing combustible emissions, a pair of combustion units positioned adjacent to the opposite end of said oven, connected to collect air containing combustible gases, freely circulating in said oven, from each end of said oven, oxidize part of said gases, heat said air, and return the air and combustion products to said oven, exhaust means connected from the central portion of said oven and discharging to atmosphere, a combustion unit in said exhaust means to oxidize substantially all of the combustible gases flowing therethrough, a heat exhanger positioned in said exhaust means beyond said combustion unit, a conduit opening into one of the combustion units on said oven to introduce outside air thereto, and said conduit extending through said heat exchanger to preheat the air passing therethrough.

14. An oven according to claim 13 in which said exhaust means comprises an exhaust fan positioned at the central portion of the oven and a conduit extending therefrom, said combustion units on said oven each comprising a combustion chamber having an inlet opening into the oven adjacent one end thereof, and a circulating fan associated with each combustion chamber having an inlet connected to the outlet of said combustion chamber and an outlet open to the oven.

15. A method of operating a plurality of side loading batch ovens in sequence which treats materials producing combustible emissions comprising circulating large volumes of relatively low temperature air containing combustible gases from each oven at a low velocity through combustion units to oxidize part of the combustible gases, heat said air, and return the air and combustion products to the respective ovens, exhausting air containing combustible gases from each oven to the next succeeding oven at a predetermined low rate, completely oxidizing the combustible gases in said air exhaust to produce a low volume of high temperature combustion products, and mixing said low volume of high temperature combustion products at a high velocity with said large volume of air circulating at low velocity from each oven through its respective combustion unit.

16. A method according to claim 15 in which the air containing combustible gases is exhausted from the final oven in sequence through a combustion unit to oxidize substantially all of the combustible gases therein and then pased in heat exchange with outside air to preheat the same, said preheated air being supplied to one of said combustion units on said final oven to support combustion therein and to heat the air recirculated to said oven.

17. A method according to claim 15 or 16 in which the air containing combustible gases circulated from each oven into the respective combustion units is withdrawn from the opposite ends of said ovens and recirculated to the central portion of said ovens.

18. A method of operating side opening batch oven which treats materials producing combustible emissions, comprising withdrawing air from one end of said oven containing a substantial amount of combustible gases, mixing said air and combustible gases with additional fuel and burning said mixture in a burner, withdrawing air from said oven at a point away from the point of said first named withdrawal of air, mixing said last named withdrawn air with the combustion products from said burner, recirculating said last named mixture to said oven, and exhausting air from said oven substantially free of combustible gases.

19. A method according to claim 18 in which said first named withdrawal of air from said oven is through a manifold positioned at one end of said oven over one end of the materials treated therein.

20. A method according to claim 19 in which the materials treated in said oven are hollow pipes coated internally with coatings which generate combustible gases on heating for drying or curing, and said manifold is positioned over one end of said pipes whereby substantially all of the air containing combustible gases is removed therethrough and the remaining air in said oven is substantially free of combustible gases.

* * * * *